US012686901B2

(12) United States Patent
Fujihara

(10) Patent No.: US 12,686,901 B2
(45) Date of Patent: Jul. 21, 2026

(54) METHOD FOR PRODUCING MARTENSITIC STAINLESS STEEL STRIP, AND MARTENSITIC STAINLESS STEEL STRIP

(71) Applicant: Proterial, Ltd., Tokyo (JP)

(72) Inventor: Hiroyoshi Fujihara, Tokyo (JP)

(73) Assignee: Proterial, Ltd., Tokyo (JP)

( * ) Notice: Subject to any disclaimer, the term of this patent is extended or adjusted under 35 U.S.C. 154(b) by 654 days.

(21) Appl. No.: 17/795,224

(22) PCT Filed: Jan. 26, 2021

(86) PCT No.: PCT/JP2021/002614

§ 371 (c)(1),
(2) Date: Jul. 25, 2022

(87) PCT Pub. No.: WO2021/153549

PCT Pub. Date: Aug. 5, 2021

(65) Prior Publication Data

US 2023/0075843 A1 Mar. 9, 2023

(30) Foreign Application Priority Data

Jan. 27, 2020 (JP) ..... 2020-010550

(51) Int. Cl.

| | |
|---|---|
| ***C21D 9/52*** | (2006.01) |
| ***C21D 8/0247*** | (2026.01) |
| ***C22C 38/18*** | (2006.01) |

(52) U.S. Cl.

CPC ..... *C21D 9/52* (2013.01); *C21D 8/0273* (2013.01); *C22C 38/18* (2013.01); *C21D 2211/008* (2013.01)

(58) Field of Classification Search

CPC ... C21D 1/25; C21D 1/26; C21D 1/76; C21D 2211/008; C21D 6/002; C21D 8/0273; C21D 9/46; C21D 9/52; C21D 9/56; C21D 9/573; C22C 38/02; C22C 38/04; C22C 38/18; C22C 38/22; C22C 38/38; C22C 38/40; C22C 38/44; Y02P 10/20

See application file for complete search history.

(56) References Cited

U.S. PATENT DOCUMENTS

| | | | | |
|---|---|---|---|---|
| 11,008,637 | B2 * | 5/2021 | Fujihara | C21D 9/52 |
| 2017/0335419 | A1 | 11/2017 | Millward et al. | |
| 2018/0195145 | A1 * | 7/2018 | Fujihara | C22C 38/04 |

FOREIGN PATENT DOCUMENTS

| | | | |
|---|---|---|---|
| CN | 102363829 | | 2/2012 |
| CN | 102876875 A | * | 1/2013 |
| CN | 104711482 | | 6/2015 |
| CN | 108300839 | | 7/2018 |
| EP | 3348655 | | 7/2018 |
| JP | H0448050 | | 2/1992 |
| JP | H10140294 | | 5/1998 |
| JP | H10274161 | | 10/1998 |
| JP | 2000129400 | | 5/2000 |
| JP | 2003213380 | | 7/2003 |
| JP | 2003231951 | | 8/2003 |
| JP | 2015067873 | | 4/2015 |
| JP | 2015221927 | | 12/2015 |
| JP | 2017508863 | | 3/2017 |
| JP | 2018111881 | | 7/2018 |
| JP | 2019173169 | | 10/2019 |
| WO | 2020013223 | | 1/2020 |

OTHER PUBLICATIONS

NPL: on-line translation of CN 102363829 A, Feb. 2012 (Year: 2012).*

NPL: on-line translation of CN 102876875 A, Jan. 2013 (Year: 2013).*

Toshihiro Tsuchiyama et al., "Quenching and partitioning treatment of a low-carbon martensitic stainless steel", Materials Science and Engineering A, Oct. 30, 2011, pp. 585-592.

"Search Report of Europe Counterpart Application", issued on Nov. 28, 2023, p. 1-p. 11.

"Office Action of China Counterpart Application", issued on Sep. 25, 2024, with English translation thereof, p. 1-p. 11.

"International Search Report (Form PCT/ISA/210) of PCT/JP2021/002614," mailed on Apr. 13, 2021, with English translation thereof, pp. 1-6.

"Office Action of China Counterpart Application", issued on Mar. 13, 2024, with English translation thereof, pp. 1-17.

* cited by examiner

*Primary Examiner* — Jie Yang
(74) *Attorney, Agent, or Firm* — JCIPRNET

(57) ABSTRACT

A method for producing a martensitic stainless steel strip, said method comprising: a quenching step wherein a steel strip, which contains, in mass %, from 0.3% to 1.2% of C and from 10.0% to 18.0% of Cr and has a thickness of 1 mm or less, is passed through a quenching furnace so as to be heated to a quenching temperature, and is subsequently cooled to a temperature that is not more than the Ms point; a heat retention conveyance step wherein the steel strip is conveyed to a an annealing furnace, while retaining the temperature of the steel strip so as not to decrease to a temperature less than 80° C.; and an annealing step wherein the steel strip is passed through the annealing furnace in a non-oxidizing gas atmosphere so as to be heated to an annealing temperature.

1 Claim, No Drawings

METHOD FOR PRODUCING MARTENSITIC STAINLESS STEEL STRIP, AND MARTENSITIC STAINLESS STEEL STRIP

CROSS-REFERENCE TO RELATED APPLICATION

This application is a 371 application of the international PCT application serial no. PCT/JP2021/002614, filed on Jan. 26, 2021, which claims the priority benefit of Japan application no. 2020-010550, filed on Jan. 27, 2020. The entirety of each of the above-mentioned patent applications is hereby incorporated by reference herein and made a part of this specification.

TECHNICAL FIELD

The present invention relates to a method for producing a martensitic stainless steel strip and a martensitic stainless steel strip.

BACKGROUND ART

Martensitic stainless steel strips are excellent in terms of corrosion resistance, hardness, and fatigue characteristics, and widely used for applications in, for example, cutting tools, spring materials to which stress is repeatedly applied, valve materials, and cover materials. In particular, in spring material and valve material applications, a martensitic stainless steel strip having sufficiently high fatigue strength is required in order to reduce fatigue breakdown due to repeated stress.

In the related art, various proposals have been made in order to improve the fatigue strength of the martensitic stainless steel strip as described above. For example, Patent Literature 1 describes a steel strip for a spring having favorable durability, which contains, in weight %, C: 0.35 to 0.45%, Si: 0.10 to 0.50%, Mn: 0.10 to 0.50%, Cr: 10 to 15%, Mo: 1.0 to 1.5%, P: 0.05% or less, S: 0.005% or less, 0:0.002% or less, N: 0.02% or less, Al: 0.005% or less, Ti: 0.01% or less, with the remainder substantially being Fe, in order to obtain a steel strip for a spring having an improved fatigue limit as compared with the conventional steel strips.

In addition, Patent Literature 2 describes a flapper valve body made of martensitic stainless steel having compressive residual stress on the plate surface and a solid-dissolved nitrogen-enriched layer in a plate surface layer part in order to improve corrosion resistance and fatigue characteristics of the flapper valve body. Here, Patent Literature 2 describes that, in an atmosphere (percentage is volume %) containing 20% or more of nitrogen and 10% or less (including 0%) of oxygen, when heating is performed to a temperature at which the phase is transformed to an austenite single phase or higher and rapid cooling is then performed, the residual stress on the surface of martensitic stainless steel can be adjusted to have a compressive stress.

In addition, in Patent Literature 3, in order to reduce shape defects without reducing productivity, the applicant of this application proposes a method for producing a martensitic stainless steel strip in which an unwinding step in which a martensitic stainless steel strip having a thickness of 1 mm or less is unwound, a quenching step in which the steel strip is passed through a quenching furnace in a non-oxidizing gas atmosphere, heated, and then cooled, an annealing step in which the steel strip after quenching is passed through an annealing furnace in a non-oxidizing gas atmosphere and tempered, a winding step in which the steel strip after annealing is wound are continuously performed, and the quenching furnace in the quenching step includes at least a temperature raising unit and a holding unit.

CITATION LIST

Patent Literature

[Patent Literature 1]
Japanese Patent Laid-Open No. H4-48050
[Patent Literature 2]
Japanese Patent Laid-Open No. H10-274161
[Patent Literature 3]
Japanese Patent Laid-Open No. 2018-111881

SUMMARY OF INVENTION

Technical Problem

In recent years, compressors for air conditioners have become highly compressed, and valves used in the compressors have been required to have improved fatigue characteristics and mechanical characteristics in order to deal with higher pressure. The invention of Patent Literature 1 is an invention that can improve the fatigue limit of a steel strip, but the fatigue limit may be insufficient depending on the usage environment, and there is room for further improvement. In addition, the invention described in Patent Literature 2 is an invention that defines compressive residual stress according to the nitrogen-enriched layer formed on the plate surface, but it is difficult for the nitrogen-enriched layer to be uniformly formed on the edge part and the outer circumference part of the valve shape, and desired residual stress may not be obtained. In addition, since the formation range of the nitrogen-enriched layer differs depending on the thickness of the material, the amount of a gas and the composition of the gas need to be changed whenever the plate thickness changes, and there is a concern of the productivity decreasing. In addition, Patent Literature 3 is an excellent invention that can obtain a martensitic stainless steel strip having excellent flatness without reducing productivity, but there is no description regarding improvement of fatigue characteristics or mechanical characteristics, and there is room for further improvement. Therefore, the present invention provides a martensitic stainless steel strip having better fatigue characteristics and mechanical strength than conventional products and a production method in which the martensitic stainless steel strip can be easily produced.

[Solution to Problem]

The present invention has been made in view of the above problems.

That is, one aspect of the present invention a method for producing a martensitic stainless steel strip, including: a quenching step in which a steel strip containing, in mass %, C: 0.3 to 1.2%, and Cr: 10.0 to 18.0%, and having a thickness of 1 mm or less is passed through a quenching furnace in a non-oxidizing gas atmosphere and heated at a quenching temperature, and then cooled to a temperature equal to or lower than the Ms point; a heat retention conveyance step in which the steel strip cooled to the temperature equal to or lower than the Ms point in the quenching step is conveyed to an annealing furnace while retaining heat so that the temperature does not drop below 80° C.; and an annealing step in which the steel strip conveyed while retaining heat so that the temperature does not drop below 80° C. in the heat retention conveyance step is passed through an annealing furnace in a non-oxidizing gas atmosphere and heated to an annealing temperature.

Another aspect of the present invention is a martensitic stainless steel strip which contains, in mass %, C: 0.3 to 1.2% and Cr: 10.0 to 18.0%, has a martensite structure, and has a thickness of 1 mm or less, wherein the amount of the residual austenite in the martensitic stainless steel strip is 10 to 25 volume %, wherein the tensile strength is 1,600 MPa or more and 2,300 MPa or less, and wherein the proof stress ratio which is a ratio of 0.2% proof stress to the tensile strength is 75% or less.

Preferably, the ratio of the compressive residual stress in a rolling direction to the compressive residual stress in a width direction of the martensitic stainless steel strip is 75% or more.

[Advantageous Effects of Invention]

According to the present invention, it is possible to obtain a martensitic stainless steel strip having better fatigue characteristics and mechanical characteristics than conventional products.

DESCRIPTION OF EMBODIMENTS

Hereinafter, the present invention will be described in detail. However, the present invention is not limited to an embodiment described herein, and appropriate combinations and improvements can be made without departing from the spirit and scope of the invention. The present invention may be applied to an object having a martensitic stainless steel composition. A composition range is not limited, but a component composition of a steel strip of the present invention preferably contains, for example, in mass %, C: 0.3 to 1.2%, Cr: 10.0 to 18.0%. In addition, the component composition of the steel strip of the present invention is preferably a martensitic stainless steel including C: 0.3 to 1.2% (more preferably 0.3 to 1.0%, and still more preferably 0.3 to 0.8%), Si: 1% or less, Mn: 2% or less, Mo: 3.0% or less (more preferably 2.5% or less, and still more preferably 2.0% or less), Ni: 1.0% or less (including 0%), Cr: 10.0 to 18.0% (more preferably 11.0% to 16.0%, and still more preferably 12.0% to 15.0%), with the remainder being made up of Fe and inevitable impurities.

First, a method for producing a martensitic stainless steel strip of the present invention will be described. The present invention is a method for producing a martensitic stainless steel strip in which a quenching step in which a steel strip having a thickness of 1 mm or less is passed through a quenching furnace in a non-oxidizing gas atmosphere, heated, and then cooled, a heat retention conveyance step in which the steel strip after the quenching step is conveyed to an annealing furnace while retaining heat (in other words, while retaining heat in a temperature range of 80° C. or higher and the Ms point or lower or lower than the annealing temperature) so that the temperature does not drop below 80° C., and an annealing step in which the steel strip conveyed in the heat retention conveyance step is passed through an annealing furnace in a non-oxidizing gas atmosphere and tempered are performed. The above quenching step, heat retention conveyance step, and annealing step may be continuously performed, and other steps, for example, a preheating step, may be added as long as the effects of the present invention are not impaired. Hereinafter, the production method of the embodiment of the present invention will be described.

(Quenching Step)

In the present embodiment, a quenching step in which the prepared steel strip is passed through a quenching furnace in a non-oxidizing gas atmosphere and heated, and the steel strip is then cooled is performed. Before conveying to the quenching furnace, an unwinding step in which a rolled steel strip wound in a coil shape is attached to an unwinding machine, and the steel strip is conveyed to the quenching furnace may be performed. The set heating temperature in the quenching furnace is preferably 850 to 1,200° C. When the set heating temperature is lower than 850° C., the amount of carbide in a solid solution state tends to be insufficient. On the other hand, when the set heating temperature exceeds 1,200° C., the amount of carbide in a solid solution state increases and the hardness during annealing tends to decrease. Here, the temperature in the quenching furnace may be set to a certain temperature from the inlet to the outlet of the furnace, and at least one of a temperature raising unit and a temperature lowering unit may be provided before and after a holding unit in which quenching is performed at a certain temperature.

In the present invention, in order to further improve the production efficiency, a preheating step may be provided between the unwinding step and the quenching step. In the preheating step, an existing heating device can be applied. However, an induction heating device that can raise the temperature of the steel strip rapidly is preferably used. In addition, in order to perform preheating effectively, the preheating temperature during the preheating step is preferably set to 600° C. or higher. On the other hand, in order to more reliably prevent deformation due to a sudden increase in the temperature, the temperature is preferably set below 800° C.

Subsequently, the steel strip heated in the quenching furnace is rapidly cooled and quenching is performed. In a rapid cooling method, a salt bath, a molten metal, an oil, water, a polymer aqueous solution, a saline, or a gas can be used. Preferably, a spray cooling method in which water is injected or a gas cooling method using a non-oxidizing gas is used. When gas cooling method is selected as the rapid cool method, it is preferable to use hydrogen, helium, nitrogen, argon, or a hydrogen mixed gas as the non-oxidizing gas. According to this rapid cooling step, the temperature of the steel strip is cooled to the Ms point or lower, but in order to obtain the effect of the heat retention conveyance step to be described below, adjustment and cooling are performed so that the temperature of the steel strip does not drop below 80°° C. In addition, in the rapid cooling step, in order to avoid pearlite nose, two-step quenching of a combination of rapid cooling and slow cooling may be performed, for example, it is preferable to perform a secondary cooling step in which the steel strip is restricted to be interposed between water cooling surface plates and is cooled to the Ms point or lower while the shape is corrected after a primary cooling step in which the steel strip is cooled to higher than the Ms point and 350° C. or lower by spray cooling.

(Heat Retention Conveyance Step)

Subsequently, in the present embodiment, the heat retention conveyance step in which the steel strip is conveyed to the annealing furnace while retaining heat so that the temperature of the steel strip after the quenching step does not drop below 80° C. is performed. When this step is provided, it is possible to increase the amount of residual austenite in the steel strip and compressive residual stress on the surface layer of the steel strip, and it is possible to obtain a fatigue strength improving effect. When the temperature during the heat retention conveyance step is lower than 80° C., it is difficult to obtain a desired amount of residual austenite. In addition, it is conceivable that, although the steel strip in the heat retention conveyance step is cooled to a temperature of the Ms point or lower in the quenching step, the steel strip is heated to higher than the Ms point due to subsequent reheating. However, it is necessary to avoid exceeding the annealing temperature set in the next annealing step. In addition, including such a case, when the temperature during heat retention becomes too high (example: higher than 300° C.), the quenching hardness tends to decrease. As a method of keeping the steel strip warm in the heat retention conveyance step, for example, a metal cover in which a heat insulating material is arranged as a heat retention instrument, a tunnel furnace or the like is installed between the quenching furnace and the annealing furnace, and the steel strip may be conveyed so that it passes through the cover or furnace described above. As the heat insulating material, an existing inorganic fiber-based or plastic-based heat insulating material or the like may be used. In addition, while an existing instrument can be used for the tunnel furnace, it is preferable to use a gas atmosphere furnace in order to obtain a stronger surface antioxidant effect and an effect of further stabilizing the temperature of the steel strip during convey. Ideally, it is most preferable that the above heat retention instrument be directly connected to the outlet of a rapid cooling instrument after quenching and the inlet of the annealing furnace, but if the temperature of the steel strip does not become lower than 80° C. until the steel strip is passed through the annealing furnace, a gap may be provided between the rapid cooling instrument and the annealing furnace and the heat retention instrument. Here, in the present embodiment, the quenching furnace and the annealing furnace to be described below are continuous furnaces, but the present invention can be implemented even when the quenching furnace and the annealing furnace are batch furnaces.

(Annealing Step)

The present embodiment includes an annealing step in which the steel strip after the heat retention conveyance step is tempered in an annealing furnace in a non-oxidizing gas atmosphere, and the steel strip is adjusted to have a desired hardness. The temperature of the annealing furnace can be set to a desired temperature depending on applications. For example, if a higher hardness property is necessary, the temperature can be set to 200 to 300° C. In addition, in order to improve shape processability such as press processing, the temperature can be set to 300° C. to 400° C. Here, when a plate passing speed is excessively high in the annealing step, there is a possibility of the above temperature range not being reached. Therefore, when a time required for the steel strip to pass through the annealing furnace is set as M[min], and the plate thickness of the steel strip is set as t[mm], M/t is preferably set to 5 to 9.

When the above quenching step, heat retention conveyance step, and annealing step are continuously performed, this is preferable because it is possible to obtain a steel strip having excellent mechanical characteristics and fatigue strength without reducing productivity.

In the steel strip after the annealing step, a polishing step may be performed in order to remove the surface layer scale of the steel strip. As the polishing method, polishing by mechanical processing such as grinding stone polishing, belt polishing, brush polishing, and buff polishing may be selected. Among these, buff polishing is preferably applied so that the scale on the surface layer can be removed without significantly damaging the surface of the steel strip.

Subsequently, the martensitic stainless steel strip of the present embodiment will be described. One of features of the martensitic stainless steel strip of the present embodiment is that the amount of residual austenite is 10 to 25 volume %. The amount of residual austenite in the steel strip after quenching is generally reduced in order to improve mechanical characteristics. In the present invention, when the amount of residual austenite in the steel strip after quenching annealing is set to 10 volume % or more, crack progress of the steel strip can be reduced and a fatigue strength property can be significantly increased without significantly deteriorating mechanical characteristics of the steel strip. On the other hand, if the amount of residual austenite is too large, since mechanical characteristics tend to significantly deteriorate, the upper limit of the amount of residual austenite is 25 volume %. The lower limit of a preferable amount of residual austenite is 12 volume %, and the upper limit of a preferable amount of residual austenite is 20 volume %. Here, in a method of measuring an amount of residual austenite in the present embodiment, an amount of residual austenite (volume %) is derived from the obtained diffracted X-ray intensity distribution using an X-ray diffractometer.

The steel strip of the present embodiment has a tensile strength of 1,600 MPa or more and 2,300 MPa or less in order to further improve the durability of the product. The lower limit of a more preferable tensile strength is 1,700 MPa, and the upper limit of a more preferable tensile strength is 2,200 MPa. The upper limit of a still more preferable tensile strength is 2,000 MPa. In addition, the steel strip of the present embodiment has the above tensile strength range and has a proof stress ratio of 75% or less, which is a ratio of the 0.2% proof stress to the tensile strength. When this proof stress ratio is set, it is possible to impart an appropriate toughness to the steel strip and further improve the fatigue strength. The lower limit of the proof stress ratio is not particularly limited, but if the proof stress ratio is too low, it tends to cause deterioration of mechanical characteristics such as hardness, and thus it can be set to, for example, 50% or more.

In the steel strip of the present embodiment, the ratio of the compressive residual stress in the rolling direction to the compressive residual stress in the width direction of the martensitic stainless steel strip is preferably 75% or more. Thereby, since the steel strip of the present invention has a small anisotropy of compressive residual stress, it is possible to reduce a variation in characteristics depending on the cutting direction. This effect is particularly effective for flapper valves which have a plurality of leads arranged radially and have a rotationally symmetric shape. Preferably, the ratio of the compressive residual stress in the rolling direction to the compressive residual stress in the width direction is 77% or more. Here, the value of the compressive residual stress is not particularly limited, but it is preferable to set the lower limit of the compressive residual stress to 300 MPa in order to obtain a fatigue strength improving effect more reliably. The lower limit of a more preferable compressive residual stress is 330 MPa, and the lower limit of a still more preferable compressive residual stress is 360 MPa. Here, the residual stress on the surface of the steel strip in the present embodiment can be measured by an X-ray residual stress measuring device. In the present embodiment, the residual stress is measured using a $2\theta$-$\sin^2\Psi$ method. Here, the rolling perpendicular direction is a direction perpendicular to the rolling direction, and corresponds to the width direction when the length direction is the rolling direction in a long steel strip.

The steel strip of the present embodiment can be applied to a martensitic stainless steel strip having a plate thickness of 1 mm or less. As the thickness is smaller, shape defects are more likely to occur due to heating during quenching. Therefore, it is preferably applied to a martensitic stainless steel strip having a plate thickness of 0.5 mm or less. Here, there is no particular need to set the lower limit of the plate thickness. However, regarding a steel plate produced by, for example, rolling, since it is difficult to produce the steel plate when the plate thickness is too thin, the thickness can be set to about 0.01 mm. The lower limit of a more preferable plate thickness is 0.05 mm, and the lower limit of a still more preferable plate thickness is 0.1 mm.

EXAMPLES

First, a martensitic stainless steel strip having a width of about 300 mm and having a thickness of 0.15 mm was prepared. The composition is shown in Table 1. The prepared steel strip was wound in a coil shape and set in an unwinding machine 1, the steel strip was unwound from the unwinding machine, and the unwound steel strip was passed through a quenching furnace in an argon gas atmosphere and whose temperature was adjusted to 850° C. to 1,200° C. Subsequently, a quenching step in which primary cooling in which pure water was sprayed on the steel strip by a cooling water spray device installed on the exit side of the quenching furnace and rapid cooling was performed and secondary cooling in which the steel strip was cooled to 290° C. to 350° C. and pressed with water cooling surface plates, and cooled to the Ms point (about 270° C.) or lower was then performed was performed. Then, a sample subjected to the heat retention conveyance step in which the steel strip after the quenching step was passed through a rock wool cylinder was used as the present invention example, and a sample on which the heat retention conveyance step was not performed was used as a comparative example. Table 2 shows the temperatures of the steel strips of the examples of the present invention and the comparative example immediately before they were conveyed to the annealing furnace. The steel strips of the examples of the present invention after the heat retention conveyance step and the steel strip of the comparative example after the quenching step were passed through the annealing furnace in an argon gas atmosphere, the temperature was adjusted to about 350° C., and annealing was performed. Finally, the steel strip after annealing was mechanically polished by buff polishing, and the steel strip was wound by a winding machine to prepare a martensitic stainless steel strip of the present invention example.

TABLE 1

| (mass %) | | | | | |
|---|---|---|---|---|---|
| C | Si | Mn | Cr | Mo | Remainder |
| 0.39 | 0.30 | 0.31 | 13.37 | 1.23 | Fe and inevitable impurities |

Subsequently, the amount of residual austenite, the residual stress, the tensile strength and the 0.2% proof stress of the prepared samples of the examples of the present invention and the comparative example were measured. The amount of residual austenite was measured using a rotating anticathode type automatic X-ray diffractometer. The residual stress was measured using a residual stress measuring device AUTOMATE-II (commercially available from Rigaku Corporation). The tensile strength and the 0.2% proof stress were measured according to the methods defined in JIS-Z2241, and a JIS13 No. B test piece was used as the test piece. Table 2 shows the amount of residual austenite and the results of the tensile strength, and Table 3 shows the measurement results of the compressive residual stress.

TABLE 2

| Sample No. | Temperature of steel strip immediately before it is inserted into annealing furnace [° C.] | Amount of residual austenite [volume %] | 0.2% proof stress [MPa] | Tensile strength [MPa] | Proof stress ratio [%] | Note |
|---|---|---|---|---|---|---|
| No. 1 | 100 | 10.1 | 1283 | 1776 | 72 | Example of present invention |
| No. 2 | 142 | 12.5 | 1070 | 1792 | 60 | Example of present invention |
| No. 11 | 40 | 3.4 | 1464 | 1812 | 81 | Comparative example |

TABLE 3

| Sample No. | Compressive residual stress (rolling direction) [MPa] | Compressive residual stress (width direction) [MPa] | Compressive residual stress ratio (rolling direction/width direction) [%] | Note |
|---|---|---|---|---|
| No. 1 | 392 | 501 | 78 | Example of present invention |
| No. 2 | 426 | 488 | 87 | Example of present invention |
| No. 11 | 336 | 453 | 74 | Comparative example |

As shown in Table 2, it was confirmed that the samples No. 1 and No. 2 subjected to the heat retention conveyance step had a larger amount of residual austenite than the sample No. 11 of the comparative example. In addition, it was also confirmed that the tensile strength was the same level as that of the comparative example and the proof stress ratio was lower than that of the comparative example. As a result, it can be understood that the examples of the present invention were advantageous in improving fatigue resistance strength while maintaining the same mechanical strength as conventional products.

Since the examples of the present invention exhibited a larger value of the compressive residual stress and had a larger compressive residual stress ratio than the comparative example, there was little variation in the compressive residual stress in the rolling direction and the width direction, and for example, improvement in productivity can be expected when applied to products such as a flapper valve material.

The invention claimed is:

1. A method for producing a martensitic stainless steel strip, comprising:

a quenching step in which a steel strip containing, in mass %, C: 0.3 to 1.2%, and Cr: 10.0 to 18.0%, and having a thickness of 1 mm or less is passed through a quenching furnace in a non-oxidizing gas atmosphere and heated at a quenching temperature, and then cooled to a temperature equal to or lower than an Ms point;

a heat retention conveyance step in which a heat retention instrument is installed between the quenching furnace and an annealing furnace, and the steel strip cooled to the temperature equal to or lower than the Ms point in the quenching step is conveyed to the annealing furnace while retaining heat so that the temperature of the steel strip does not drop below 80° C. before annealing; and an annealing step in which the steel strip conveyed while retaining heat so that the temperature does not drop below 80° C. in the heat retention conveyance step is passed through an annealing furnace in a non-oxidizing gas atmosphere and heated to an annealing temperature, wherein the martensitic stainless steel strip has a martensite structure, an amount of the residual austenite in the martensitic stainless steel strip is 10 to 25 volume %, a tensile strength of the martensitic stainless steel strip is 1,600 MPa or more and 2,300 MPa or less, a proof stress ratio which is a ratio of 0.2% proof stress to the tensile strength of the martensitic stainless steel strip is 75% or less, and a ratio of compressive residual stress in a rolling direction to compressive residual stress in a rolling width direction of the martensitic stainless steel strip is 75% or more.

* * * * *